US008850795B2

(12) United States Patent
Ikeda

(10) Patent No.: US 8,850,795 B2
(45) Date of Patent: Oct. 7, 2014

(54) AFTER-TREATMENT APPARATUS FOR EXHAUST GAS RIGHT AFTER A COMBUSTION CHAMBER

(75) Inventor: Yuji Ikeda, Kobe (JP)

(73) Assignee: Imagineering, Inc., Kobe-shi (JP)

( * ) Notice: Subject to any disclaimer, the term of this patent is extended or adjusted under 35 U.S.C. 154(b) by 1059 days.

(21) Appl. No.: 12/881,897

(22) Filed: Sep. 14, 2010

(65) Prior Publication Data

US 2011/0030347 A1 Feb. 10, 2011

Related U.S. Application Data

(63) Continuation-in-part of application No. PCT/JP2009/054962, filed on Mar. 13, 2009.

(30) Foreign Application Priority Data

Mar. 14, 2008 (JP) ..... 2008-066886

(51) Int. Cl.

| | |
|---|---|
| ***F01N 3/08*** | (2006.01) |
| ***F02B 77/08*** | (2006.01) |
| ***F01L 3/24*** | (2006.01) |
| ***F01L 3/02*** | (2006.01) |
| *F01L 3/06* | (2006.01) |
| *F01L 3/08* | (2006.01) |
| *F02P 13/00* | (2006.01) |
| *F02P 23/04* | (2006.01) |

(52) U.S. Cl.

CPC ..... *F01L 3/02* (2013.01); *F02B 77/087* (2013.01); *F01L 3/06* (2013.01); *F01L 3/24* (2013.01); *F01L 3/08* (2013.01); *F01N 3/0892* (2013.01); *F02P 13/00* (2013.01); *F02P 23/045* (2013.01); *F01N 2240/28* (2013.01)

USPC ..... 60/275

(58) Field of Classification Search

USPC ..... 60/275; 123/143 R, 143 B, 151, 169 EL, 123/536, 606

See application file for complete search history.

(56) References Cited

U.S. PATENT DOCUMENTS

| | | | |
|---|---|---|---|
| 7,392,795 | B2 | 7/2008 | Nagamine et al. |
| 2004/0060281 | A1 | 4/2004 | Breuer et al. |
| 2007/0266979 | A1 | 11/2007 | Nagamine et al. |

FOREIGN PATENT DOCUMENTS

| | | | |
|---|---|---|---|
| JP | 59-215967 | A | 12/1984 |
| JP | 7-224643 | A | 8/1995 |

(Continued)

OTHER PUBLICATIONS

International Search Report of PCT/JP2009/054962, mailing date Jun. 9, 2009.

*Primary Examiner* — Kenneth Bomberg
*Assistant Examiner* — Jonathan Matthias
(74) *Attorney, Agent, or Firm* — Westerman, Hattori, Daniels & Adrian, LLP

(57) ABSTRACT

Provided is an after-treatment apparatus for exhaust gas right after a combustion chamber, which apparatus comprises a discharge device with an electrode exposed to an exhaust port installed in a cylinder head, an antenna installed on the back face of a valve head, an electromagnetic wave transmission line installed in a valve stem with one end connected to the antenna and the other end, covered with an insulator or dielectric and extending to and connected to a power-receiving portion, which is positioned at a location fitting into the guide hole or at a location farther from the valve head in the valve stem, and an electromagnetic wave generator for feeding electromagnetic waves to the power-receiving portion. The after-treatment apparatus is configured such that discharge is generated with the electrode of the discharge device and electromagnetic waves fed from the electromagnetic wave generator through the electromagnetic wave transmission line are radiated from the antenna.

14 Claims, 5 Drawing Sheets

(56) References Cited

FOREIGN PATENT DOCUMENTS

| | | | |
|---|---|---|---|
| JP | 2753574 | A | 5/1998 |
| JP | 2002-276333 | A | 9/2002 |
| JP | 2004-169643 | A | 6/2004 |
| JP | 2004-293522 | A | 10/2004 |
| JP | 2004-353596 | A | 12/2004 |
| JP | 2005-502823 | A | 1/2005 |
| JP | 2006-132483 | A | 5/2006 |
| JP | 2007-113570 | A | 5/2007 |
| JP | 2007-309160 | A | 11/2007 |

AFTER-TREATMENT APPARATUS FOR EXHAUST GAS RIGHT AFTER A COMBUSTION CHAMBER

TECHNICAL FIELD

The present invention belongs to the technical field of the internal combustion engine and relates to an after-treatment apparatus for the exhaust gas from an internal combustion engine. The apparatus uses an exhaust valve to open and close an exhaust port in the side of the combustion chamber.

BACKGROUND OF THE INVENTION

The gas in an internal combustion engine contains gas state components, PM (Particulate Matter, can say Particulate), unburned hydrocarbons (UBS or HC), carbon monoxide (CO), nitric oxides ($NO_X$), carbon dioxide ($CO_2$), water vapor ($H_2O$), oxygen ($O_2$), and nitrogen ($N_2$) and so on. PM in exhaust gas from, for example diesel among internal combustion engines, points solid or liquid particles larger than 10 μm. The solid or liquid particles include soot consisting of carbonaceous, combustible organic fraction that consists high-boiling-point carbon hydride and sulfate moieties.

For example, Patent Document 1 discloses a discharge type exhaust gas control apparatus that includes a diesel particulate filter and a plasma generator as an exhaust gas control apparatus for eliminating these components from exhaust gas. The diesel particulate filter is installed in the exhaust passage. The plasma generator is combined with the diesel particulate filter or installed upstream of the filter. The plasma generator stably supplies $NO_2$ and active substances (active oxygen), which are needed for the combustion (oxidation) of exhaust particulates collected by the particulate filter, in the discharge-type exhaust gas control apparatus.

Patent Document 2 discloses an exhaust gas control apparatus comprising an after-treatment device which cleans aeration exhaust gas in the middle of exhaust pipe from an internal combustion engine. The exhaust gas control apparatus includes a plasma generator, flow-through oxidation catalyst, a means of adding fuel and increasing the temperature. The plasma generator generates plasma by discharging into the exhaust gas above the after-treatment device. The style oxidation catalyst is installed before the plasma generator. Fuel is added to the exhaust gas before the oxidation catalyst by the means of adding fuel. The means of increasing the temperature elevates temperature of exhaust gas until occurring oxidation, on the oxidation catalyst, of fuel added by the means of adding fuel. Using this apparatus to energize exhaust gas with the discharge of the plasma generator into the exhaust gas, the unburned carbon hydride is converted into active radicals, oxygen into ozone, NO into $NO_2$. These exhaust gas components becomes active, resulting in a greater exhaust purification effect than with existing after-treatment devices from low temperature area.

Patent Document 3 discloses an after-treatment method for exhaust gas and apparatus for it. In this apparatus, an after-treatment unit for exhaust gas, a particulate filter, is placed in the exhaust pipe and an oxidation reactor, a plasma reactor, is installed upstream from it. When the oxidation reactor generates non-heat plasma in the exhaust gas flowing through the oxidation reactor, oxidants are generated from the exhaust gas components. As the result, soot is incinerated with the oxidants in the particulate filter, and reproduced.

Patent Document 4 discloses an exhaust gas purification apparatus. It contains a filter that catches particulate matter, an absorbent that absorb components of the exhaust gas, and a plasma generator that generate plasma with applied voltage, in exhaust smoke path of the internal combustion engine. The exhaust gas purification apparatus eliminates the accumulated particles on the filter and absorbent material or the exhaust gas components at normal temperature below the particulate ignition temperature. It enables the removal of harmful substances and particulates contained in internal combustion engine gases, such as diesel exhaust gas, at exhaust temperatures below 150° C.

Patent Document 5 discloses an exhaust purification apparatus comprising a means of purification and a means of forming plasma. The purifier is installed in the exhaust path of the internal combustion engine, and contains NOx-absorbing materials and/or a particle filter. The means of forming plasma is installed in the exhaust path. The exhaust purification apparatus comprises a means of detecting oxygen density and controlling means. The means of detecting oxygen density detects oxygen density in exhaust gas. The controlling means results in the purification of the exhaust gas due to the means of purification when the oxygen density on the means of detecting oxygen density, decreasing the oxygen density in the exhaust gas while simultaneously driving the means of forming plasma when the amount of absorbed material exceeds a predetermined value. If applying this apparatus for stationary fuel system, such as steam generator and gas turbine, or transferring fuel system such as diesel automobile, the cost is lower than that of existing plasma processes because of un-necessity of firm power. Moreover it will be possible to remove NOx and soot at the same time effectively by plasma desorption at high density.

Patent Document 6 discloses a ways to reduce particle matter included in the exhaust gas from a lean-burn engine. In the ways to reduce particle matter, plasma is generated in the exhaust gas, includes particle matter, from lean-burn engine etc. As the result, several carbon dioxide and ozone are generated and the particle matter is oxidized by these carbon dioxide and ozone.

Patent Document 7 discloses an exhaust gas breaking apparatus. This exhaust gas breaking apparatus comprises a microwave oscillation device, microwave resonant cavity, microwave radiation means, and ignition means using plasma. The microwave oscillation device generates certain microwave marginal zone. The microwave resonant cavity resonates part of the microwave zone. The microwave radiation means radiates microwave to the microwave resonant cavity. The ignition means forms gas plasma by partly discharging in the gas inside said microwave resonant cavity. Said microwave radiation mean is arranged in circumferential direction in periphery of flow path where exhaust gas flows. Said microwave radiation mean is a microwave radiating antenna with a configuration and size such that a strong electric field place, where plasma generating area generated with microwave becomes the same in the passage section, is generated. Applying this apparatus, carbon-carbon and carbon-hydrogen bonds are broken by the strong oxidation power of ozone and OH radicals along with plasma generation in exhaust gas, including unborn gas, soot, and NOx in combustion/reactive room. As a result, it becomes stabilizes harmless oxide such as $NO_2$ and $CO_2$ or carbon via the chemical reaction involving oxidation and OH radicals. The exhaust gas components are rendered harmless.

[Patent Document 1] Japanese Patent Application Laid-open Publication No. 2002-276333

[Patent Document 2] Japanese Patent Application Laid-open Publication No. 2004-353596

[Patent Document 3] Japanese Patent Application Laid-open Publication No. 2005-502823

[Patent Document 4] Japanese Patent Application Laid-open Publication No. 2004-293522

[Patent Document 5] Japanese Patent Application Laid-open Publication No. 2006-132483

[Patent Document 6] Japanese Patent Application Laid-open Publication No. 2004-169643

[Patent Document 7] Japanese Patent Application Laid-open Publication No. 2007-113570

SUMMARY OF THE INVENTION

In the case of technique in Patent Documents 1 through 6, a particulate filter or other exhaust gas depuration apparatus is installed in much lower place from the portion of the exhaust passage formed in the cylinder head of an internal combustion engine in the light of the layout. Therefore, the temperature of the exhaust gas decreases before reaching the exhaust depuration apparatus from the combustion chamber. For that point, it is thought to clean the exhaust gas effectively by elevating the temperature in the exhaust depuration apparatus so as to promote oxidation reaction etc. of the exhaust gas components in the exhaust gas depuration. However, a rich air-to-fuel ratio or excessive afterburning downstream of the combustion chamber will get terrible mileage of the internal combustion engine.

The inventor of the present invention extrapolated the mechanism of combustion promotion in the internal combustion engine which is disclosed in Patent Document 7, and obtained a constant finding about the mechanism. In this mechanism, a small amount of plasma is discharged firstly. The plasma is irradiated with microwaves for a given period of time, so that the amount of plasma increases. Thus a large amount of OH radicals and ozone is generated from moisture in the air-fuel mixture within a short period of time, promoting an air-fuel mixture reaction. Furthermore, by using a large amount of OH radicals and ozone property, it will be able to promote oxidation reaction of the exhaust gas components.

In the view of the foregoing, the present invention has been achieved. An object of the invention is to provide an after-treatment apparatus to clean the exhaust gas highly efficiently. This after-treatment apparatus uses the space, of an exhaust port, right after combustion chamber as a reactor. In the reactor, the combustion-promoting mechanism obtained by generating a large amount of OH radicals and ozone with plasma is applied. The oxidation reaction etc. of the exhaust gas components is promoted by providing high temperature exhaust gas with a large amount of OH radicals and ozone. As a result, a highly efficient exhaust gas cleanup is achieved.

The present invention is an after-treatment apparatus for exhaust gas right after a combustion chamber, which is installed in an internal combustion engine in which the combustion chamber side opening of an exhaust port is opened/closed at a given timing with a valve head at the end of a valve stem of an exhaust valve, the exhaust port is formed in a cylinder head and connects to the combustion chamber to be part of the exhaust passage, the valve stem fits into a guide hole penetrating from the exhaust port to the outer wall of the cylinder head and reciprocating freely, the after-treatment apparatus comprises a discharge device with an electrode exposed to the exhaust port installed in the cylinder head, an antenna installed on the back face of the valve head, an electromagnetic wave transmission line installed in the valve stem with one end connected to the antenna and the other end, covered with an insulator or dielectric and extending to and connected to a power-receiving portion, which is positioned at a location fitting into the guide hole or at a location farther from the valve head in the valve stem, and an electromagnetic wave generator for feeding electromagnetic waves to the power-receiving portion, wherein the after-treatment apparatus is configured such that discharge is generated with the electrode of the discharge device and electromagnetic waves fed from the electromagnetic wave generator through the electromagnetic wave transmission line are radiated from the antenna.

In the actuation of the internal combustion engine, discharge is generated at the electrode of the discharge device and the electromagnetic waves fed from the electromagnetic wave generator through the electromagnetic wave transmission line are radiated from the antenna. Therefore, the plasma is generated near the electrode. This plasma receives energy of an electromagnetic waves (electromagnetic wave pulse) supplied from the antenna for a given period of time. As a result, the plasma generates a large amount of OH radicals and ozone to promote the oxidation reaction etc. of the exhaust gas components. In fact electrons near the electrode are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the oxidation reaction etc. of the exhaust gas components.

In that case, the oxidation reaction etc. are initiated at an exhaust port located right after the combustion chamber, which is used as a reactor. The high temperature of the exhaust gas also promotes the oxidation reactions, which increases cleanup efficiency in combination with the oxidation reaction etc. obtained by generating a large amount of OH radicals and ozone with plasma. Therefore, it is not necessary to use a rich air-to-fuel ratio or afterburning downstream of the combustion chamber, which would prevent the mileage reduction of the internal combustion engine.

The after-treatment apparatus of the present invention may be applicable for which the antenna forms nearly a C shape to surround the valve stem on the back face of the valve head and one end of the antenna is connected to the electromagnetic wave transmission line.

This makes the antenna compact on the back face of valve head.

The after-treatment apparatus of the present invention may be applicable for which the power-receiving portion exposed on the outer wall of valve stem, and the after-treatment apparatus includes a dielectric member installed in the cylinder head and near the power-receiving portion, at least when the valve head closes the combustion chamber side opening of the exhaust port, made from dielectric material, and an power-feeding member made from conductive material, which is installed in the cylinder head close to the dielectric member opposite the valve stem, wherein after-treatment apparatus is configured such that the power-feeding member would be fed the electromagnetic waves from the electromagnetic wave generator.

This makes it possible to have non-contact electromagnetic wave transmission from the electromagnetic wave generator to the electromagnetic wave transmission line through the power-feeding member, the dielectric member, and the power-receiving portion.

The after-treatment apparatus of the present invention may be applicable for which a valve guide mounted hole, which penetrates from the exhaust port to the outer wall of cylinder head, is installed in the cylinder head, a valve guide with trunk shape made from dielectric material fits into the valve guide mounted hole allowing a hole in the valve guide to serve as a guide hole, and a portion of the valve guide, approaching the power-receiving portion at least when the valve head closes the combustion chamber side opening of the exhaust port, is the dielectric member.

This makes it possible to have non-contact electromagnetic wave transmission from the electromagnetic wave generator to the electromagnetic wave transmission line by using heretofore known mechanism for mounting the valve guide.

The after-treatment apparatus of the present invention may be applicable for which an electromagnetic wave-leakage inhibition member, installed in the cylinder head to block the exhaust port downstream of the exhaust valve and the electrode along exhaust gas flow, allowing the exhaust gas to pass through, and reducing the electromagnetic waves progressing from upstream toward downstream along exhaust gas flow.

This makes it possible that the electromagnetic wave-leakage inhibition member prevents electromagnetic waves from being scattered and lost downstream along the exhaust gas flow. Moreover, the back face of the valve head of the exhaust valve prevents some electromagnetic waves from scattering from the exhaust port to the combustion chamber. In addition, electromagnetic waves are absolutely prevented from scattering from the exhaust port to the combustion chamber when the exhaust valve closes the combustion chamber side opening of the exhaust port. Therefore, closed space of an exhaust port or space according to it becomes a reactor, where the oxidation reaction etc. of the exhaust gas components is stably initiated.

The after-treatment apparatus of the present invention may be applicable for which the electrode is located close to a portion where the electric field intensity generated by the electromagnetic waves around the back face of the valve head becomes strong when the electromagnetic waves are fed to the antenna.

This makes it possible that the electromagnetic wave pulse irradiates the plasma generated by the discharge at the electrode from the antenna near plasma. The energy is intensively supplied to said plasma. As a result, a large amount of OH radicals and ozone is efficiently generated, further promoting the oxidation reaction etc. of the exhaust gas components.

DESCRIPTION OF REFERENCE CHARACTERS

Figure 1:
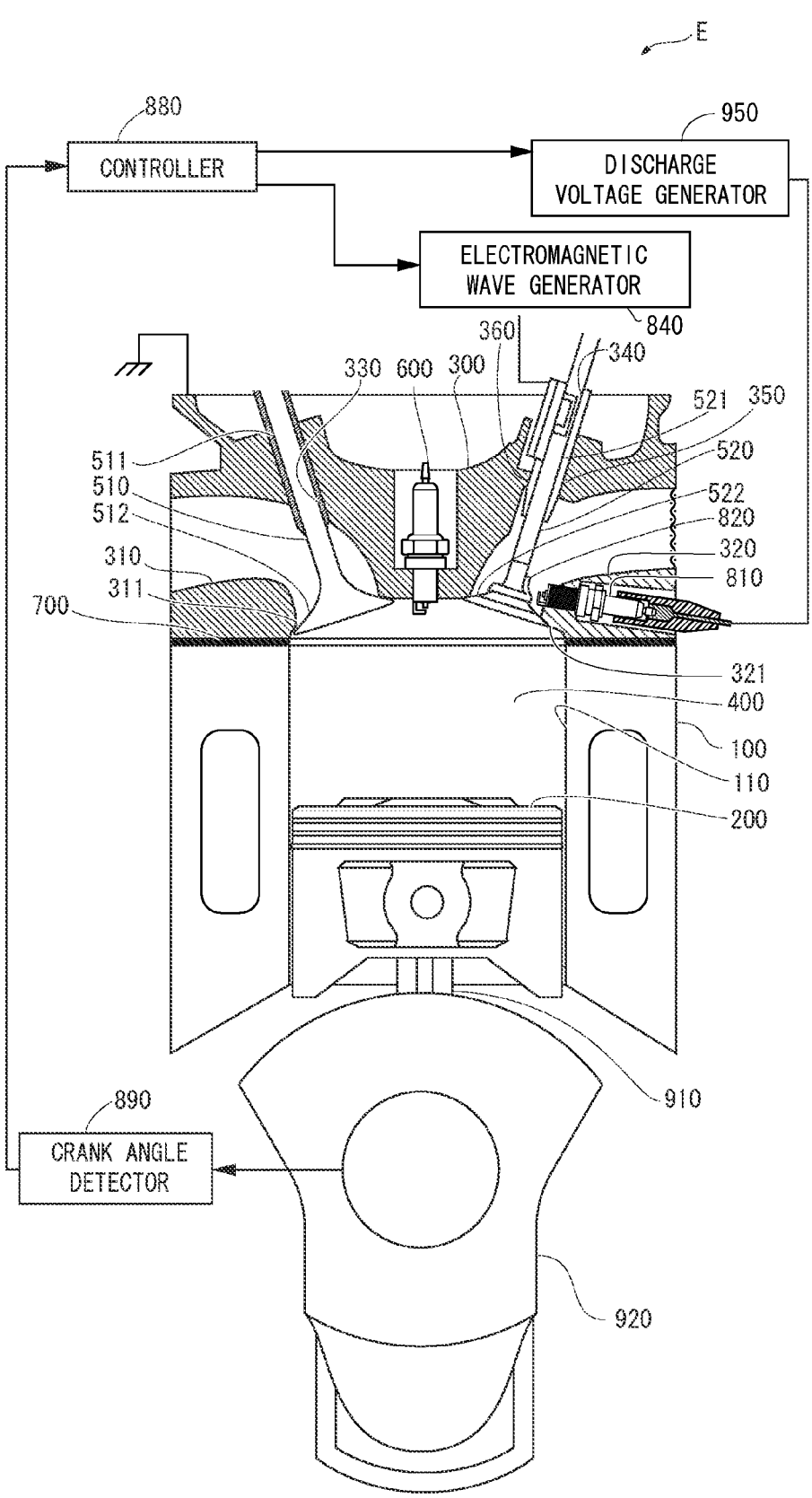
FIG. 1 shows a vertical cross-sectional view of combustion chamber in an internal combustion engine with the after-treatment apparatus for exhaust gas right after a combustion chamber in the first embodiment of the present invention.

E Internal combustion engine
100 Cylinder block
110 Cylinder
200 Piston
300 Cylinder head
320 Exhaust port
321 Opening
340 Guide hole
350 Valve guide mounted hole
360 Valve guide
400 Combustion chamber
520 Exhaust valve
521 Valve stem
521*a* Basic portion
521*b* Periphery portion
521*c* Power-receiving portion
522 Valve head
522*a* Basic portion
522*b* Valve face
810 Discharge device
812 First electrode
813 Second electrode
820 Antenna
830 Electromagnetic wave transmission line
840 Electromagnetic wave generator
850 Dielectric member
860 Power feeding member
870 Electromagnetic wave-leakage inhibition member

DETAILED DESCRIPTION OF THE INVENTION

Hereinafter, embodiments of the present invention will be described. FIG. 1 shows the embodiment of the internal combustion engine E comprising the after-treatment apparatus for exhaust gas right after a combustion chamber of the present invention. The present invention targets reciprocating engines. In this embodiment, engine E is a four-cycle gasoline engine. Item 100 is the cylinder block. Cylinder block 100 contains cylinder 110, which has an approximately circular cross section. Cylinder 110 penetrates cylinder block 100. Piston 200, which has an approximately circular cross section corresponding to cylinder 110, fits into cylinder 110 and reciprocates freely. Cylinder head 300 is assembled on the anti-crankcase side of cylinder block 110. Cylinder head 300, piston 200, and cylinder 110 form combustion chamber 400. Item 910 is a connecting rod, with one end connected to piston 200 and the other end connected to crankshaft 920, which is the output shaft. Cylinder head 300 has intake port 310, which is a component of the intake line, and exhaust port 320, which is a component of the exhaust line. One end of intake port 310 connects to combustion chamber 400; the other end is open at the outside wall of cylinder head 300. One end of exhaust port 320 connects to combustion chamber 400;

the other end is open at the outside wall of cylinder head 300. The cylinder head has guide hole 330 that passes through intake port 310 to the outside wall of cylinder head 300. Rod-shaped valve stem 511 of intake valve 510 fits into guiding hole 330 and reciprocates freely. Umbrella-shaped valve head 512, set at the end of valve stem 511, opens and closes the combustion chamber side opening of intake port 310 at a given timing by a valve open/close mechanism having a cam and so on (not shown in the figure). Cylinder head 300 has guiding hole 340 that passes through exhaust port 320 to the outside wall of cylinder head 300. Rod-shaped valve stem 521 of exhaust valve 520 fits into guiding hole 340 and reciprocates freely. Umbrella-shaped valve head 522, set at the end of valve stem 521, opens and closes the combustion chamber side opening 321 of the exhaust port 320 at a given time by the valve open/close mechanism having cam and so on (not shown in the figure). Item 600 is a spark plug installed in cylinder head 300 to expose the electrode to combustion chamber 400. Spark plug 600 discharges at the electrodes when piston 200 is near top dead center. Therefore, four strokes (intake, compression, combustion of mixture, and exhaust of exhaust gas) occur while piston 200 reciprocates between top dead center and bottom dead center twice. However, this embodiment does not restrict the interpretation of the internal combustion engine targeted by the present invention. The present invention is also suitable for use with two-stroke internal combustion engines and diesel engines. Target gasoline engines include direct-injection gasoline engines, which create a mixture inside the combustion chamber to inject fuel into the intake air. Target diesel engines include direct-injection diesel engines, which inject fuel into the combustion chamber directly, and divided-chamber diesel engines, which inject fuel into the divided chamber. Internal combustion engine E in this embodiment has four cylinders, but this does not restrict number of cylinders of the internal combustion engine targeted by the present invention. The internal combustion engine for this embodiment has two intake valves 510 and two exhaust valves 520, but this does not restrict the number of intake or exhaust valves of the internal combustion engine targeted by the present invention. Item 700 is a gasket installed between cylinder block 100 and cylinder head 300.

Figure 2:
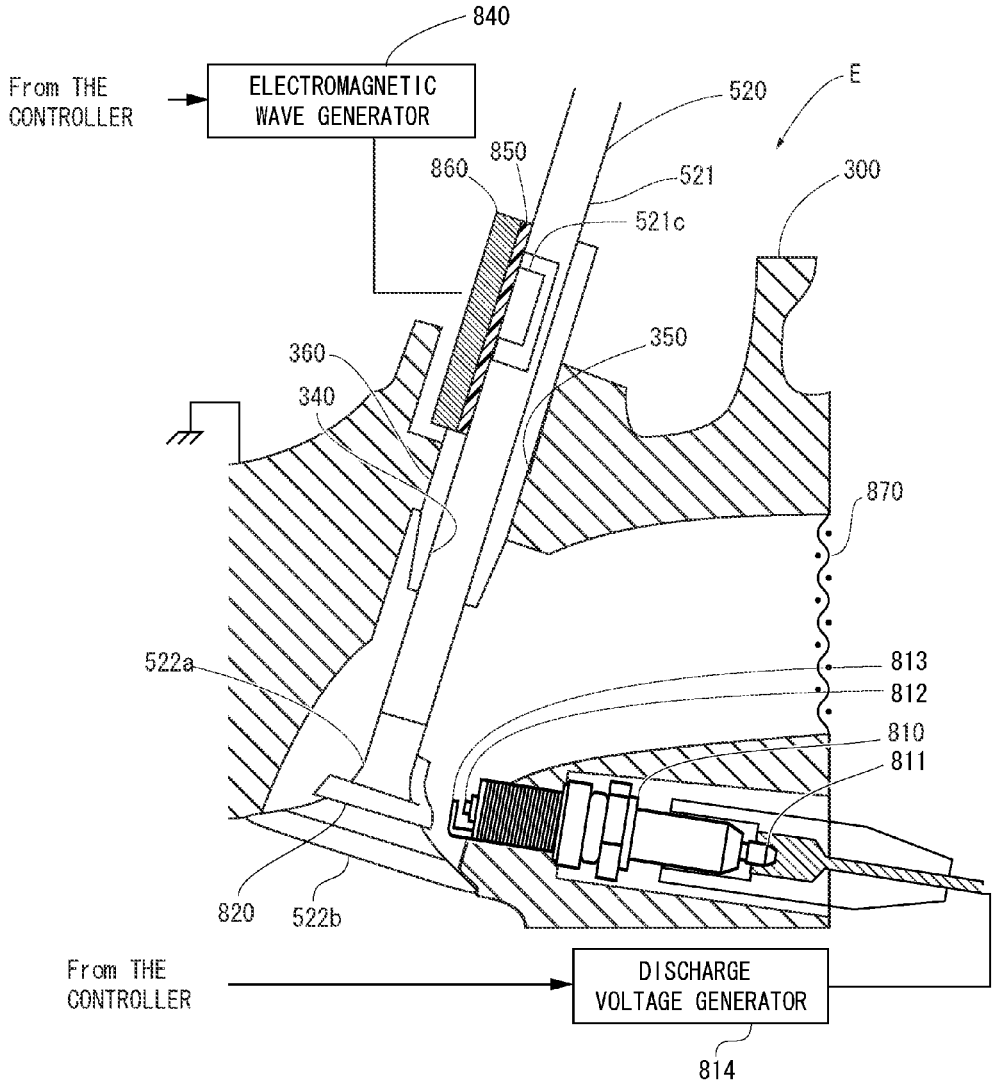
FIG. 2 shows an enlarged vertical cross-sectional view of exhaust port in an internal combustion engine with the after-treatment apparatus for exhaust gas right after a combustion chamber in the first embodiment of the present invention.

Discharge device 810 is installed in cylinder head 300, as shown in FIG. 2. Discharge device 810 has electrodes exposed at exhaust port 320. In this embodiment, a spark plug for gasoline engine is used as a discharge device 810. This spark plug is installed at wall exhaust port 320. The spark plug has connector 811, first electrode 812, and second electrode 813. Connection 811 is located outside of exhaust port 320. First electrode 812 is exposed to exhaust port 320 and electrically connected to connector 811. First electrode 812 and second electrode 813 face each other, with a specific clearance between them. Second electrode 813 contacts cylinder head 300, and conduction occurs between them. Discharge device 810 is connected to discharge voltage generator 950 generating voltage for discharge. Discharge voltage generator 950 is a 12-V DC power source, but this can also be a piezo element or other device. Discharge occurs between first electrode 812 and second electrode 813 when cylinder head 300 is earthed, connector 811 is connected to discharge voltage generator 950, and voltage is applied between cylinder head 300 and connector 811. Discharge device 810 is only intended to generate plasma through the discharge, and is not necessarily a spark plug. A discharge volume is not considered. Moreover, the discharge can occur between the electrode of the discharge device and the wall of the exhaust port or other earth members.

Figure 4:
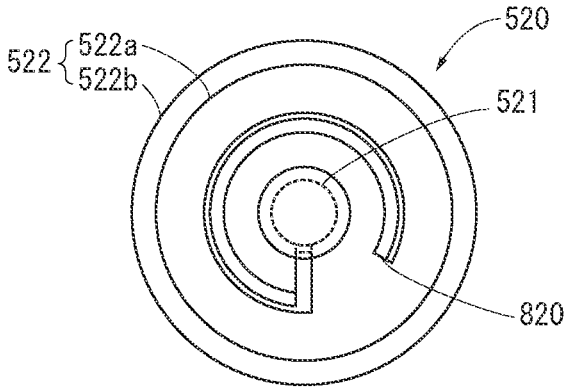
FIG. 4 shows an enlarged view of exhaust valve used in the after-treatment apparatus for exhaust gas right after a combustion chamber in the first embodiment of the present invention, as seen from the edge of the valve stem to the valve head.

Antenna 820 is installed on back face of valve head 522 of exhaust valve 520, as shown in FIGS. 2 and 4. Antenna 820 is made from metal. However, it can be made from a conductor, dielectric, or insulator, provided that electromagnetic waves are radiated well from it to the exhaust port when they are supplied between the antenna and the earth member. Antenna 820 is a bar-style unit with curvature and forms nearly a C shape to surround valve stem 521 in the back of valve head 522. Antenna 820 radiates electromagnetic waves to exhaust port 320. In fact, Antenna 820 forms nearly a C shape, in sum circularity with hiatus, to surround valve stem 521, as seen along the direction of valve stem 521 extending. The interior of valve stem 521 that fits into guide hole 340 is made from a dielectric and consists of a basic portion 521*a*. A fitting portion into the guide hole 340 on the periphery of the basic portion 521*a* is made from metal, as a periphery portion 521*b*. Metal is used to enhance the rub and burning resistance; however, it can also be made from other materials. Also, no fitting portions into the guide hole 340 can be made from dielectric on the valve stem 521. In addition, a successive portion to the basic portion 521*a* of the valve stem 521 is made from dielectric and becomes a basic portion 522*a* on the valve head 522. Valve face 522*b* on the side of combustion chamber 400 is made from metal to enhance burning resistance. However, valve face 522*b* can be made from other materials. Antenna 820 is installed on the back of valve head 522*a*. Here, Antenna 820 is made from a ceramic as a dielectric; however, it can be made from other dielectrics or insulators. For example, the length of the circular arc part of antenna 820 is set to a quarter of the wavelength of the electromagnetic waves so that standing waves are generated in the antenna 820, increasing the electrical field strength at the end of the antenna 820. For example, the length of the antenna 820 is set to a multiple of a quarter wavelengths of the electromagnetic waves so that standing waves are generated in the antenna 820, increasing the electrical field at multiple points, where the anti-nodes of the standing waves are generated, in the antenna 820. Antenna 820 can be buried in valve head 522. Additionally, first electrode 821 and second electrode 813 are located close to a portion of strong electrical field intensity around the back face of the valve head 522 of the exhaust valve 520 due to the electromagnetic waves when the electromagnetic waves are fed to the antenna 820. Here, the leading end of the antenna 820 is close to first electrode 821 and second electrode 813. Therefore, when electromagnetic waves are supplied between antenna 820 and cylinder head 300 as the earth member, electromagnetic waves are radiated from antenna 820 to exhaust port 320. One end of antenna 820 is connected to electromagnetic wave line 830, which is described below. In this embodiment, antenna 820 is a rod-shaped monopole antenna that is curved one. However, this does not restrict the type of antenna in the after-treatment apparatus for gas of the present invention. Therefore, antenna of the after-treatment apparatus for gas of the present invention may be dipole type, Yagi-Uda type, single wire type, loop type, phase difference feeder type, grounded type, ungrounded and perpendicular type, beam type, horizontal polarized omni-directional type, corner-reflector type, comb type or other type of linear antenna, microstrip type, planar inverted F type or other type of flat antenna, slot type, parabola type, horn type, horn reflector type, Cassegrain type or other type of solid antenna, Beverage type or other type of traveling-wave antenna, star EH type, bridge EH type or other type of EH antennas, bar type, small loop type or other type of magnetic antenna, or dielectric antenna.

Figure 3:
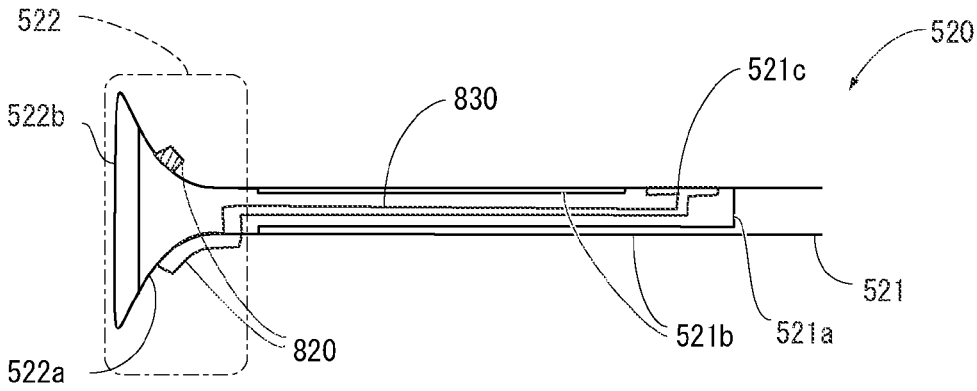
FIG. 3 shows an enlarged vertical cross-sectional view of exhaust valve used in the after-treatment apparatus for exhaust gas right after a combustion chamber in the first embodiment of the present invention.

Electromagnetic wave transmission line 830, made from copper line, is installed in valve stem 521 of exhaust valve 520, as shown in FIG. 3. This electromagnetic waves transmission line 780 is made from copper line. Electromagnetic wave transmission line 830 may also be made from any conductor, insulator, or dielectric, as long as electromagnetic waves are transmitted well to antenna 820 when they are supplied between antenna 820 and the earthed member. A possible variation is an electromagnetic wave transmission line that consists of a waveguide made from a conductor or dielectric. Power-receiving portion 521*c* is installed in a fitting portion into valve guide 340 of valve stem 521. Power-receiving portion 521*c* can be made from a conductor, dielectric, or insulator. Here, power-receiving portion 521*c* is located at the periphery of valve stem 521, but it can also be located inside it. The configuration and material of power-receiving portion 521*c* is selected according to the connection method to power-feeding member 860, as described below. Power-receiving portion 521*c* can be positioned at a location farther from the valve head in the valve head than a fitting portion into the guide hole of the valve stem. One end of electromagnetic wave transmission line 830 is connected to antenna 820. The other end, which is covered with an insulator or dielectric, extends to power-receiving portion 521*c* at a fitting portion into the guide hole 340 of valve stem 521 and connects to it. Electromagnetic wave transmission line 830 runs inside basic portion 521*a* of valve stem 521. Therefore the other end of electromagnetic wave transmission line 830 is covered with a dielectric and extends to power-receiving portion 521*c*. Whereas basic portion 521*a* is made from dielectric, the other end of the electromagnetic wave transmission line is covered with an insulator and extends to power-receiving portion. Thus, when electromagnetic waves are supplied between power-receiving portion 521*c* and the earth member such as cylinder head 300, they are introduced into antenna 820.

Electromagnetic wave generator 840, which supplies electromagnetic waves to power-receiving portion 521*c*, is installed in internal combustion engine E or its surroundings. Electromagnetic wave generator 840 generates electromagnetic waves. In this embodiment of electromagnetic wave generator 840 is a magnetron that generates 2.4-GHz-bandwidth microwaves. However, this does not restrict interpretation of composition of electromagnetic wave generator of the after-treatment apparatus for gas of the present invention.

Power-receiving portion 521*c* is exposed on the outer surface of valve stem 521 in exhaust valve 520, as shown in FIGS. 2 and 3. Dielectric member 850 and power-feeding member 860 are in Cylinder head 300. Dielectric member 850 is made from a ceramic and approaches power-receiving portion 521*c* at least when valve head 522 of exhaust valve 520 closes the exhaust port opening in the side of the combustion chamber. Dielectric member 850 must be made from a dielectric. Power-feeding member 860 is made from metal. Power-feeding member 860 is close to the dielectric member 850 opposite the valve stem of exhaust valve 520. Power-feeding member 860 must be made from conductive material. The electromagnetic wave transmission method between power-feeding member 860 and power-receiving portion 521*c* via dielectric member 850 can be either electric coupling (capacitive) or magnetic coupling (dielectric). The configuration and material of power-feeding member 860 and power-receiving portion 521*c* may be selected according to the method. For example, in the case of electric coupling, power-feeding member 860 and power-receiving portion 521*c* should be conductive plates facing each other. The power feeding member 860 and the power receiving portion 521*c* may be respectively electric antenna with predefined advantage to electromagnetic waves generated by the electromagnetic wave generator 840. In the case of magnetic coupling, power-feeding member 860 and power-receiving portion 521*c* should be conductive coils. The power feeding member 860 and the power receiving portion 521*c* may be respectively a magnetic antenna with predefined advantage to electromagnetic waves generated by the electromagnetic wave generator 840. As a result, the electromagnetic wave generator 840 provides the power feeding member 860 with electromagnetic waves when the power feeding member 860 receives an output signal of the electromagnetic wave generator 840.

As shown in FIG. 2, valve guide mounted hole 350, which penetrates from the exhaust port 320 to the outer wall of cylinder head 300, is installed in the cylinder head 300. Valve guide with trunk shape made from a ceramics fits into the valve guide mounted hole 350, allowing a hole in the valve guide 360 to serve as a guide hole 340. Valve guide may be made from dielectric material. In valve guide 360, a portion approaching the power-receiving portion 521*c* at least when the valve head 522 of the exhaust valve 520 closes the combustion chamber side opening of the exhaust port 320 is the dielectric member 850.

Electromagnetic wave-leakage inhibition member 870 is installed in cylinder head 300 and blocks the exhaust port 320 downstream of the exhaust valve 520 on the exhaust port 320, first electrode 812, and second electrode 813 along exhaust gas flow. Electromagnetic wave-leakage inhibition member 870 fulfills a function allowing the exhaust gas to pass through and a function reducing the electromagnetic waves progressing from upstream toward downstream along exhaust gas flow. Reduction means both reflecting and absorbing. Therefore, Electromagnetic wave-leakage inhibition member 870 fulfills a function allowing the exhaust gas to pass through and a function reflecting and absorbing the electromagnetic waves progressing from upstream toward downstream along exhaust gas flow. Electromagnetic wave-leakage inhibition member 870 is composed of a metallic mesh which is a mesh made from metals. The metallic mesh with a predefined mesh size adjusted to the cross-sectional shape of exhaust port 320. The outer edge of the metallic mesh is connected to the outer wall of exhaust port 320. The metallic mesh allows the exhaust gas to pass through and reduces the electromagnetic waves progressing from upstream toward downstream along exhaust gas flow. Instead of this, the electromagnetic wave-leakage inhibition member can be composed by multiple tube members. This electromagnetic wave-leakage inhibition member is fixed on the wall by inserting the exhaust port that the rube hole points to the exhaust port. These tubes allow the exhaust gas to pass through, and reduce electromagnetic waves progressing from upstream to downstream along exhaust gas flow.

In this after-treatment apparatus for gas, a discharge is generated between first electrode 812 and second electrode 813, and electromagnetic waves fed from the electromagnetic wave generator 840 through the electromagnetic wave transmission line 830 are radiated from the antenna 820. Cylinder block 100 or cylinder head 300 are earthed. The earth terminals of discharge voltage generator 950 and electromagnetic wave generator 840 are earthed. Discharge voltage generator 950 and electromagnetic wave generator 840 are controlled by controller 880, which has a CPU, memory, and storage etc, and outputs control signals after computing input signals. A signal line from crank angle detector 890 for detecting crank angle of crankshaft 920 is connected to control unit 880. Crank angle detection signals are sent from crank angle detector 890 to controller 880. Therefore, controller 880 receives signals from crank angle detector 890 and controls the actuations of discharge device 810 and electromagnetic wave generator 840. However, this does not restrict the control method and the composition of the input-output signals as for after-treatment apparatus for gas of the present invention.

In the actuation of the internal combustion engine E, discharge is generated at first electrode 812 and second electrode 813 of the discharge device 810 and the electromagnetic waves fed from the electromagnetic wave generator 840 through the electromagnetic wave transmission line 830 are radiated from the antenna 820. Therefore, the plasma is generated near first electrode 812 and second electrode 813. This plasma receives energy of an electromagnetic waves (electromagnetic wave pulse) supplied from the antenna 820 for a given period of time. As a result, the plasma generates a large amount of OH radicals and ozone to promote the oxidation reaction etc. of the exhaust gas components. In fact electrons near first electrode 812 and second electrode 813 are accelerated, fly out of the plasma area, and collide with gas such as air or the air-fuel mixture in surrounding area of said plasma. The gas in the surrounding area is ionized by these collisions and becomes plasma. Electrons also exist in the newly formed plasma. These also are accelerated by the electromagnetic wave pulse and collide with surrounding gas. The gas ionizes like an avalanche and floating electrons are produced in the surrounding area by chains of these electron acceleration and collision with electron and gas inside plasma. These phenomena spread to the area around discharge plasma in sequence, then the surrounding area get into plasma state. In the result of the phenomena as mentioned above it, the volume of plasma increases. Then the electrons recombine rather than dissociate at the time when the electromagnetic wave pulse radiation is stopped. As a result, the electron density decreases, and the volume of plasma decreases as well. The plasma disappears when the electron recombination is completed. A large amount of OH radicals and ozone is generated from moisture in the gas mixture as a result of a large amount of the generated plasma, promoting the oxidation reaction etc. of the exhaust gas components.

In that case, the oxidation reaction etc. are initiated at an exhaust port 320 located right after the combustion chamber 400, which is used as a reactor. The high temperature of the exhaust gas also promotes the oxidation reactions, which increases cleanup efficiency in combination with the oxidation reaction etc. obtained by generating a large amount of OH radicals and ozone with plasma. Therefore, it is not necessary to use a rich air-to-fuel ratio or afterburning downstream of the combustion chamber, which would prevent the mileage reduction of the internal combustion engine.

The configuration and structure of the antenna are not restricted for the after-treatment apparatus for exhaust gas right after a combustion chamber of the present invention. In the first embodiment of the after-treatment apparatus for exhaust gas, antenna 770 forms nearly a C shape to surround valve stem 521 on the back face of valve head 522 of exhaust valve 520 among such varied embodiments. One end of antenna 820 is connected to electromagnetic wave transmission line 830. This makes the antenna 820 compact on the back face of valve head 522.

The structure for transmitting electromagnetic waves from the electromagnetic wave generator to the electromagnetic wave transmission line is not restricted for the after-treatment apparatus for exhaust gas right after a combustion chamber of the present invention. In the first embodiment of the after-treatment apparatus for exhaust gas, power-receiving portion 521*c* is exposed on the outer surface of valve stem 521 of exhaust valve 520 among such varied embodiments. The after-treatment apparatus has dielectric member 850 and power-feeding member 860. Dielectric member 850 is installed in cylinder head 300 and approaches power-receiving portion 521*c* at least when valve head 522 of exhaust valve 520 closes the exhaust port 320 opening in the side of combustion chamber. Dielectric member 850 is made from dielectric material. Power-feeding member 860 is installed in cylinder head 300. Power-feeding member 860 is close to the dielectric member 850 opposite the valve stem 521. Power-feeding member 860 is made from conductive material. Power-feeding member 860 is fed electromagnetic waves from electromagnetic wave generator 840. This makes it possible to have non-contact electromagnetic wave transmission from electromagnetic wave generator 840 to electromagnetic wave transmission line 830 through power-feeding member 860, dielectric member 850, and power-receiving portion 521*c*.

The structure near the guide hole is not restricted for the after-treatment apparatus for exhaust gas right after a combustion chamber of the present invention. In the first embodiment of the after-treatment apparatus for exhaust gas, a valve guide mounted hole 350, which penetrates from the exhaust port 320 to the outer wall of cylinder head 300, is installed in the cylinder head 300 among such varied embodiments. A valve guide 360 with trunk shape, made from dielectric material, fits into the valve guide mounted hole 350 allowing a hole in the valve guide 360 to serve as a guide hole. A portion of the valve guide 360, approaching the power-receiving portion 521*c* at least when the valve head 522 closes the combustion chamber side opening of the exhaust port 320, is the dielectric member. This makes it possible to have non-contact electromagnetic wave transmission from electromagnetic wave generator 840 to electromagnetic wave transmission line 830 by using heretofore known mechanism for mounting the valve guide.

The present invention includes an embodiment of the after-treatment apparatus that does not have electromagnetic wave-leakage inhibition member in the exhaust port. However, the after-treatment apparatus in the first embodiment includes electromagnetic wave-leakage inhibition member 870 among such varied embodiments. Electromagnetic wave-leakage inhibition member 870 blocks the exhaust port 320 downstream of the exhaust valve 520 on the exhaust port 320, first electrode 812, and second electrode 813 along exhaust gas flow in the cylinder head 300, allowing the exhaust gas to pass through, and reducing the electromagnetic waves progressing from upstream toward downstream along exhaust gas flow. This makes it possible that the electromagnetic wave-leakage inhibition member 870 prevents electromagnetic waves from being scattered and lost downstream along the exhaust gas flow. Moreover, the back face of the valve head 522 of the exhaust valve 520 prevents some electromagnetic waves from scattering from the exhaust port 320 to the combustion chamber 400. In addition, electromagnetic waves are absolutely prevented from scattering from the exhaust port 320 to the combustion chamber 400 when the exhaust valve 520 closes the combustion chamber side opening of the exhaust port 320. Therefore, closed space of an exhaust port 320 or space according to it becomes a reactor, where the oxidation reaction etc. of the exhaust gas components is stably initiated.

The positional relationship between the antenna and the electrode is not restricted for exhaust gas right after a combustion chamber of the present invention. In the first embodiment of the after-treatment apparatus for exhaust gas right after a combustion chamber, first electrode 812 and second electrode 813 are located close to a portion where the electric field intensity generated by the electromagnetic waves around the back face of the valve head 522 of the exhaust valve 520 becomes strong when the electromagnetic waves are fed to the antenna 820. This makes it possible that the electromagnetic wave pulse irradiates the plasma generated by the discharge at first electrode 812 and second electrode 813 from the antenna near plasma. The energy is intensively supplied to said plasma. As a result, a large amount of OH radicals and ozone is efficiently generated, further promoting the oxidation reaction etc. of the exhaust gas components.

Figure 5:
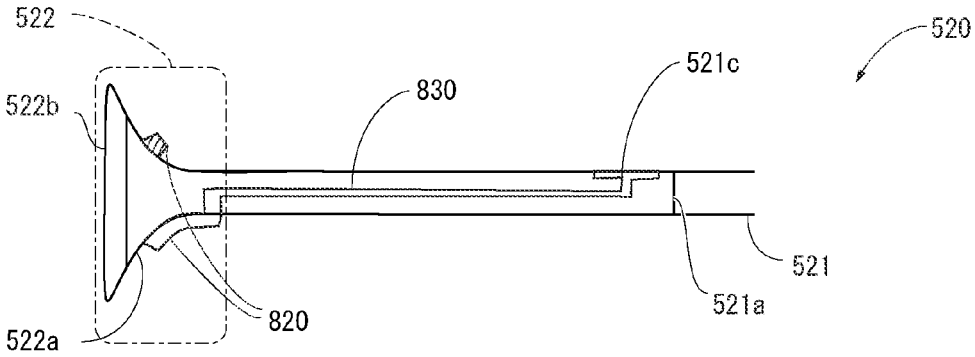
FIG. 5 shows an enlarged vertical cross-sectional view of exhaust valve used in the after-treatment apparatus for exhaust gas right after a combustion chamber in the second embodiment of the present invention.

Next, the second embodiment of the after-treatment apparatus for exhaust gas right after a combustion chamber of the present invention will be described. This after-treatment apparatus for exhaust gas in the second embodiment differs from the first embodiment only in the composition of exhaust valve 520. In the exhaust valve 520 of the after-treatment apparatus for exhaust in the first embodiment, the interior of valve stem 521 that fits into guide hole 340 is made from a dielectric or insulator as a basic portion 521*a*. Moreover, a fitting portion into the guide hole 340 on the periphery of the basic portion 521*a* is made from metal as a periphery portion 521*b*. In the exhaust valve 520 of the after-treatment apparatus for exhaust in the second embodiment, not only basic portion 521*a* but periphery portion 521*b* are an integral structure and are made from a dielectric or insulator, as shown in FIG. 5. This increases the relative volume of the dielectric or insulator for the same valve stem 521 diameter. Thus, if the impedance of electromagnetic wave transmission line 830 is same level between the first and second embodiments, the cross-sectional area of electromagnetic wave transmission line 830 for the second embodiment will be larger, increasing the transmitting efficiency. Other functions and effects are similar to the first embodiment of the after-treatment apparatus for exhaust gas.

In the after-treatment apparatus for exhaust gas right after a combustion chamber of the present invention, a pair of the electrodes or a pair of the electrode and the earth member may as well be covered with a dielectric. In this case, the dielectric-barrier discharge is generated by voltage applied between the electrodes or between the electrode and the earth member. The dielectric-barrier discharge is restricted because charges are accumulated in the surface of the dielectric covering the electrode or the earth member. Therefore, the discharge is generated on a very small scale over a very short period of time. Thermalization does not occur in the area surrounding the discharge because the discharge is terminated after a short period of time. Therefore, the gas temperature rise due to the discharge between the electrodes is reduced, which reduces the amount of NOx produced by the internal combustion engine.

The present invention includes some embodiments that combine the characteristics of the embodiments described above. Moreover, the embodiments described above are only examples of the after-treatment apparatus for exhaust gas right after a combustion chamber of the present invention. Thus, the description of these embodiments does not restrict interpretation of the after-treatment apparatus for exhaust gas right after a combustion chamber of the present invention.

The invention claimed is:

1. An after-treatment apparatus for exhaust gas from a combustion chamber of an internal combustion engine, comprising:

a cylinder head which defines at least a portion of the combustion chamber, the cylinder head having an exhaust port;

an exhaust valve having a valve stem which extends to the exhaust passage and having a valve head at a combustion chamber side such that the exhaust port is opened/closed at a given timing;

a discharge device with an electrode exposed to the exhaust port;

an antenna installed on the back side of the valve head; and an electromagnetic wave transmission line installed in the valve stem with one end connected to the antenna and the other end connected to a power-receiving portion to which electromagnetic waves are fed.

2. The after-treatment apparatus according to claim 1, wherein the antenna forms a C shape to surround the valve stem on the back face of the valve head and one end of the antenna is connected to the electromagnetic wave transmission line.

3. The after-treatment apparatus according to claim 2, wherein the power-receiving portion is exposed on the outer wall of valve stem, the after-treatment apparatus further comprising:

a dielectric member made from dielectric material and installed in the cylinder head at a position at which the power-receiving portion approaches the dielectric member at least when the valve head closes the exhaust port at the combustion chamber side; and a power-feeding member made from conductive material, which is installed in the cylinder head at a position close to the dielectric member on a side opposite to the valve stem;

wherein the after-treatment apparatus is configured such that the power-feeding member would be fed the electromagnetic waves from the electromagnetic wave generator.

4. The after-treatment apparatus according to claim 2, further comprising:

an electromagnetic wave-leakage inhibition member, installed in the cylinder head to block the exhaust port downstream of the exhaust valve and the electrode along exhaust gas flow, allowing the exhaust gas to pass through, and reducing the electromagnetic waves progressing from upstream toward downstream along exhaust gas flow.

5. The after-treatment apparatus according to claim 2, wherein the electrode is located close to a portion where the electric field intensity generated by the electromagnetic waves around the back face of the valve head becomes strong when the electromagnetic waves are fed to the antenna.

6. The after-treatment apparatus according to claim 1, wherein the power-receiving portion exposed on the outer wall of the valve stem, the after-treatment apparatus further comprising:

a dielectric member made from dielectric material and installed in the cylinder head at a position at which the power-receiving portion approaches the dielectric member at least when the valve head closes the exhaust port at the combustion chamber side; and a power-feeding member made from conductive material, which is installed in the cylinder head close to the dielectric member opposite the valve stem;

wherein the after-treatment apparatus is configured such that the power-feeding member would be fed the electromagnetic waves from the electromagnetic wave generator.

7. The after-treatment apparatus according to claim 6, further comprising:

a valve guide mounted hole which penetrates from the exhaust port to the outer wall of cylinder head and which is installed in the cylinder head, a valve guide with a trunk shape made from dielectric material which fits into the valve guide mounted hole allowing a hole in the valve guide to serve as a guide hole, the valve guide having the dielectric member at a portion of the valve guide, at which the power-receiving portion approaches the dielectric member at least when the valve head closes the exhaust port at the combustion chamber side.

8. The after-treatment apparatus according to claim 7, further comprising:

an electromagnetic wave-leakage inhibition member, installed in the cylinder head to block the exhaust port downstream of the exhaust valve and the electrode along exhaust gas flow, allowing the exhaust gas to pass through, and reducing the electromagnetic waves progressing from upstream toward downstream along exhaust gas flow.

9. The after-treatment apparatus according to claim 7, wherein the electrode is located close to a portion where the electric field intensity generated by the electromagnetic waves around the back face of the valve head becomes strong when the electromagnetic waves are fed to the antenna.

10. The after-treatment apparatus according to claim 6, further comprising:

an electromagnetic wave-leakage inhibition member, installed in the cylinder head to block the exhaust port downstream of the exhaust valve and the electrode along exhaust gas flow, allowing the exhaust gas to pass through, and reducing the electromagnetic waves progressing from upstream toward downstream along exhaust gas flow.

11. The after-treatment apparatus according to claim 6, wherein the electrode is located close to a portion where the electric field intensity generated by the electromagnetic waves around the back face of the valve head becomes strong when the electromagnetic waves are fed to the antenna.

12. The after-treatment apparatus according to claim 1, further comprising:

an electromagnetic wave-leakage inhibition member, installed in the cylinder head to block the exhaust port downstream of the exhaust valve and the electrode along exhaust gas flow, allowing the exhaust gas to pass through, and reducing the electromagnetic waves progressing from upstream toward downstream along exhaust gas flow.

13. The after-treatment apparatus according to claim 12, wherein the electrode is located close to a portion where the electric field intensity generated by the electromagnetic waves around the back face of the valve head becomes strong when the electromagnetic waves are fed to the antenna.

14. The after-treatment apparatus according to claim 1, wherein the electrode is located close to a portion where the electric field intensity generated by the electromagnetic waves around the back face of the valve head becomes strong when the electromagnetic waves are fed to the antenna.

* * * * *